US005643679A

United States Patent [19]

Ishimaru et al.

[11] Patent Number: 5,643,679

[45] Date of Patent: Jul. 1, 1997

[54] DECORATIVE ARTICLE

[75] Inventors: Yoko Ishimaru; Hirobumi Ohmori; Shin-ichi Nakamura; Michihiko Inaba, all of Yokohama, Japan

[73] Assignee: Kabushiki Kaisha Toshiba, Kanagawa-ken, Japan

[21] Appl. No.: 990,618

[22] Filed: Dec. 14, 1992

[30] Foreign Application Priority Data

Dec. 16, 1991 [JP] Japan ..... 3-331069
Mar. 26, 1992 [JP] Japan ..... 4-068010

[51] Int. Cl.[6] ..... C22C 9/00

[52] U.S. Cl. ..... 428/472; 428/216; 428/336; 428/469; 428/697; 428/699; 428/701; 428/702

[58] Field of Search ..... 428/469, 472, 428/336, 701, 702, 697, 699, 216

[56] References Cited

U.S. PATENT DOCUMENTS

| | | | |
|---|---|---|---|
| Re. 31,474 | 12/1983 | Brook et al. | 148/11.5 R |
| 2,430,419 | 11/1947 | Edens | 75/161 |
| 3,652,261 | 3/1972 | Taubenblat | 75/161 |
| 3,837,894 | 9/1974 | Tucker, Jr. | 117/70 |
| 3,861,938 | 1/1975 | Jackson | 148/161 |
| 3,918,957 | 11/1975 | Suzuki et al. | 75/10 R |
| 4,077,052 | 2/1978 | Vossen, Jr. | 358/128 |
| 4,196,237 | 4/1980 | Patel et al. | 75/251 |
| 4,491,622 | 1/1985 | Butt | 428/472 |
| 4,500,605 | 2/1985 | Fister et al. | 428/469 |
| 4,569,702 | 2/1986 | Ashok et al. | 148/436 |
| 4,629,662 | 12/1986 | Brownlow et al. | 428/469 |
| 4,642,146 | 2/1987 | Ashok et al. | 420/490 |
| 4,661,178 | 4/1987 | Ashok et al. | 420/469 |
| 4,822,693 | 4/1989 | Ashok et al. | 420/458 |
| 4,869,758 | 9/1989 | Watanabe et al. | 148/326 |
| 5,004,581 | 4/1991 | Takagi et al. | 428/487 |
| 5,188,799 | 2/1993 | Mori et al. | 420/469 |
| 5,315,152 | 5/1994 | Kuse et al. | 257/677 |

OTHER PUBLICATIONS

Koji Sugioka et al., "Control of Surface Color of Stainless Steel 304 by KrF Excimer Laser Implant Deposition," Jpn. J. Appl. Phys. Lett., 29(7):L1185–L1187 (July 1990).

T.E. Evans et al., "A New Process For Colouring Stainless Steel," Trans. Inst. Metal Finishing, 50:77–79 (1972).

*Primary Examiner*—Archene Turner
*Attorney, Agent, or Firm*—Finnegan, Henderson, Farabow, Garrett & Dunner, L.L.P.

[57] ABSTRACT

A decorative article comprises as essential components 5 to 95% by weight of Cu 5 to 95% by weight of a copper based component in which at least one kind of metal selected from a group consisting of Au, Pb, Zn, Sn, Ni and Al is solid-dissolved in Cu, and a balance of Fe and unavoidable impurities. The decorative article exhibits a color tone satisfying a formula $x \geqq 0.3$ and/or $y \geqq 0.3$ for which chromaticity coordinates x and y in a X-Y-Z colorimetric system are used. Usually, the decorative article iron alloy is practically used in the form of a plate and contains a cast structure in a part of its matrix while exhibiting a dislocation density of $10^2$ dl/cm$^2$ or more. The cast structure is a dendritic structure which extends from the surface of the plate in the direction of a thickness of the latter. A thickness of the dendritic structure is determined to be 1/10 or more of the thickness of the plate.

22 Claims, 4 Drawing Sheets

DECORATIVE ARTICLE

BACKGROUND OF THE INVENTION

The present invention relates to a decorative article. More particularly, the present invention relates a decorative article having excellent mechanical characteristic while exhibiting warm color tone and excellent colorability (decorativeness).

For example, various kinds of materials such as stainless steel, Cu alloy, Al alloy or Ti alloy have been widely used as a decorative article for an interior/exterior lining material for an electric equipment such as an electric refrigerator, an electronic oven or the like, an interior/exterior lining material for a building, an exterior lining material for interior furnishings such as a kitchen instrument, an interior or exterior material for transportion machines and equipments, or the like and other industrial decorative article. Specifically, a decorative article made of each of the decorative articles as mentioned above generally exhibits excellent weather proofness and corrosion resistance, and moreover, it has a comparatively good color tone. Further, it is suitably employable for interior decoration, an outdoor signboard (guide plate) and a decorative article to be borne by an user. For this reason, all the aforementioned decorative articles are widely put in practical use. With respect to the industrial decorative articles as mentioned above, many requests have been raised from users so as to exhibit a higher decorative effect (more excellent colorability), more excellent mechanical characteristic.

However, a decorative article made of various kinds of materials such as stainless steel, Cu alloy, Al alloy or Ti alloy as mentioned above has the following disadvantageous problems from the viewpoint of practical use. For example, in case that a stainless steel and a Ti alloy are used as a decorative article, the resultant decorative article exhibits cold-feeling color tone. On the other hand, in case that a Cu alloy and an Al alloy are used as a decorative article, since they are inferior to the preceding decorative articles in respect of a surface hardness, tough they have relatively good-feeling color tone the resultant decorative article has problems that it is susceptible to injury or scratch. Otherwise, its decorative effect is readily lost. At any rate, the industrial decorative article which has been hitherto known and practically used has some advantages and some disadvantages. Thus, the present status is that any one of the aforementioned decorative articles fails to meet the requirements for excellent colorability (decorativeness) and excellent mechanical characteristic.

In view of the problems as mentioned above, trials have been made for adding to an Al alloy to be used for a decorative article at least one kind of metallic element selected from a group consisting of Zn, Sn and Ni. However, the resultant aluminum alloy still has unsolved problems in respect of mechanical strength and hardness.

The present invention has been made in consideration of the foregoing background.

An object of the present invention is to provide a decorative article suitably employable for industrial use wherein the decorative article exhibits warm-hearted color tone, excellent colorability (decorativeness) and excellent mechanical characteristic, and moreover, it is suitably subjected to surface treatment such as etching or the like.

SUMMARY OF THE INVENTION

According to the first aspect of the present invention, there is provided a decorative article comprising 5 to 95% by weight of a copper based component, the copper based component being selected from the group consisting of Cu and a copper alloy, wherein the copper alloy is a copper solid solution, the copper alloy comprising not more than 100 parts by weight of at least a metal selected from the group consisting of Au, Pb, Zn, Sn, Ni and Al based on 100 parts by weight of Cu, 0 to 20% by weight of Cr, 0 to 25% by weight of Ni and the balance of Fe and unavoidable impurities.

The decorative article according to the second aspect of the present invention comprises a two phase separated Cu—Fe composite, which essentially consists of a copper phase and an iron phase, wherein the decorative article has a color tone satisfying the formula of $x \geqq 0.3$ and/or $y \geqq 0.3$ for color tone coordinates x and y in the X-Y-Z colorimetric system.

Further, according to another aspect of the present invention, there is provided a decorative article wherein the copper iron composite contains a cast structure in at least a part of its matrix of which a dislocation density is $10^2$ dl/cm$^2$ and/or more or a {100} plane of each copper crystal or iron crystal extends substantially in parallel with the surface of the decorative article to exhibit excellent etching properties.

A first type of decorative article which is subjected to surface treatment according to the present invention has a surface layer of which Cu concentration is kept high, and moreover, it includes a gradient structure of which Cu concentration is gradually reduced toward an inner layer. In other words, a ratio of a Cu concentration n1 in the matrix to a Cu concentration n2 on the surface layer of the copper iron composite plate, i.e., n2/n1 is larger than 1.

A second type of decorative article which is subjected to surface treatment according to the present invention is characterized in that a surface oxide layer is formed on the surface of the copper iron composite.

A third type of decorative article which is subjected to surface treatment according to the present invention is characterized in that Cu in the surface layer is removed but a surface layer having a high concentration of Fe is formed on the surface of the copper iron composite.

DESCRIPTION OF THE PREFERRED EMBODIMENTS

Figure 1:
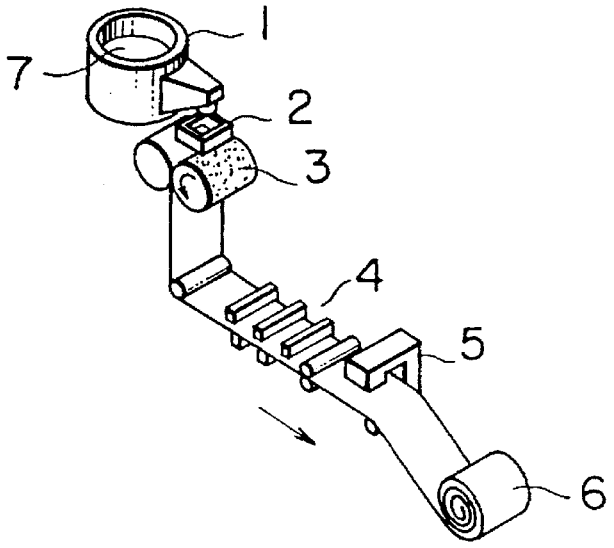
FIG. 1 is an illustrative view which shows by way of example a process of producing a decorative article according to the present invention.
Figure 2:
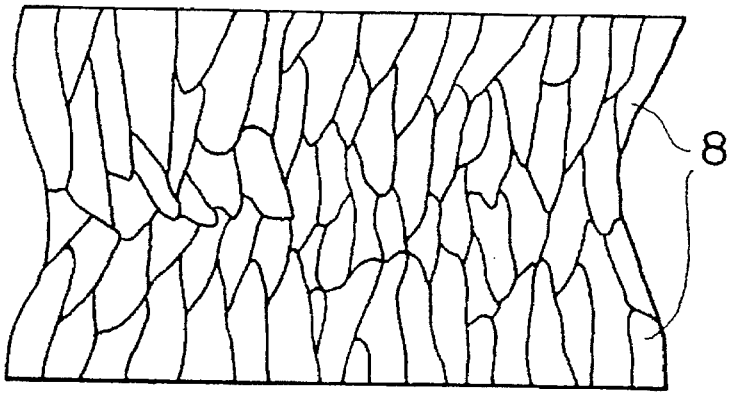
FIG. 2 to FIG. 9 are microscopical photographs each of which shows by way of example a metallurgical structure of the decorative article plate produced according to the present invention.
Figure 3:
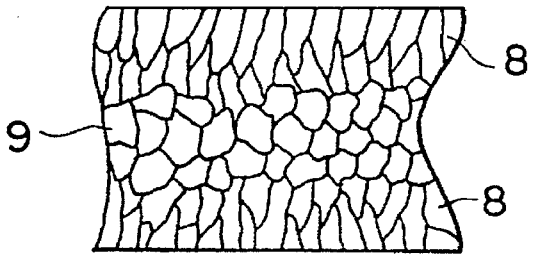
Figure 4:
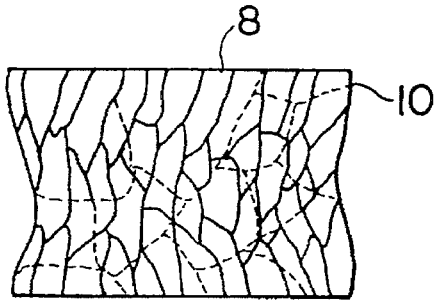
Figure 5:
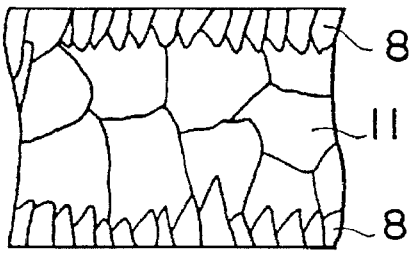

According to the present invention, in case that a content of Cu or a content of Cu based component which is a Cu solid-solution is less than 5% by weight, values representing chromaticity coordinates x and y in a X-Y-Z colorimetric system are reduced, resulting in a warm color tone of a decorative article becoming short. On the contrary, in case that the content exceeds 95% by weight, hardness of the copper iron composite becomes short and the copper iron composite does not serve as a decorative article. On the other hand, in case that at least one kind of metal selected from a group consisting of Au, Pb, Zn, Sn, Ni and Al is solid-dissolved in the copper iron composite, when its content in terms of parts by weight exceeds the above-specified value per a content of Cu of 100 parts by weight, a mechanical strength of the copper iron composite is reduced (i.e., the copper iron composite becomes brittle). For this reason, it is necessary that a content of the selected metal is selectively determined to be less than the above-specified value in terms of parts by weight.

Chromaticity coordinates (x, y) represent characteristics of a certain color. The color exhibiting warm feeling of the invention is obtained by satisfying a formula of $x \geqq 0.3$ and/or $y \geqq 0.3$ or $y \geqq -0.5+0.46$ using the chromaticity coordinates (x, y).

Metals other than the above-noted ones may be added to the alloy for the decorative article of the present invention, if necessary. Among them, P, Mg, Be and Mn are noted as metals each of which can be solid-dissolved in Cu. Description will be made below with respect to a quantity of addition of each of the metals (to a Cu phase). P can be added by a quantity of 0.05 to 0.5% by weight, preferably, 0.1 to 0.25% by weight for the purpose of improving hardness of the copper iron composite, Mg can be added 0.01 to 1.0% by weight, preferably, 0.1 to 0.8% by weight for the purpose of improving strength, of the copper iron composite, Be can be added by a quantity of 0.01 to 3.0% by weight, preferably, 0.2 to 0.25% by weight for the purpose of improving corrosion resistance of the copper iron composite, and Mn can be added by a quantity of 0.01 to 20% by weight, preferably, 0.1 to 10% by weight for the purpose of improving a tensile strength of the copper iron composite.

C, B, N, Mn, Si W, V, Co and Mo are noted as elements each of which can be solid-dissolved in Fe while affecting hardness of the copper iron composite. In addition, Ni, Nb, Al , Y, Zr, Ti, Mo, C and Cr are noted as elements each of which can be solid-dissolved in Fe while affecting corrosion resistance of the copper iron composite. Description will be made below with respect to a quantity of addition of each of the elements (to a Fe phase). C can be added by a quantity of 0,001 to 0.5% by weight, preferably, 0.002 to 0.1% by weight, B can be added by a quantity of 0.001 to 0.1% by weight, preferably, 0.02 to 0.003% by weight, N can be added by a quantity of 0.002 to 0.1% by weight, preferably, 0.01 to 0.04% by weight, Mn can be added by a quantity of 0.01 to 3% by weight, preferably, 0.1 to 2% by weight, Si can be added by a quantity of 0.005 to 5% by weight, preferably, 0.05 to 1.0% by weight, W can be added by a quantity of 0.9 to 60% by weight, preferably, 2 to 20% by weight, V can be added by a quantity of 0.04 to 2% by weight, preferably, 0.08 to 1% by weight, Co can be added 0.01 to 9% by weight, preferably, 1 to 6% by weight, Mo can be added by a quantity of 0.08 to 12% by weight, preferably, 0.03 to 1.6% by weight, Ni can be added by a quantity of 0.01 to 10% by weight, preferably, 1 to 8% by weight, Nb can be added by a quantity of 0.08 to 10% by weight, preferably, 1.2 to 4.2% by weight, Al can be added by a quantity of 0.02 to 1.8% by weight, preferably, 0.04 to 0.8% by weight, Y can be added by a quantity of 0.01 to 6% by weight, preferably, 0.1 to 1% by weight, Zr can be added by a quantity of 0.01 to 5% by weight, preferably, 0.05 to 0.1% by weight, Ti can be added by a quantity of 0.08 to 10% by weight, preferably, 0.1 to 5% by weight, and Cr can be added by a quantity of 0.1 to 25% by weight, preferably, 1 to 20% by weight, if necessary.

It is not always necessary that all the aforementioned elements are solid-dissolved in the matrix. Alternatively, they may be precipitated in a Cu phase, a Fe phase or a grain boundary. For example, $Fe_3C$, $W_2C$, $MO_2C$, $V_4C_3$ and $Cr_7C_3$ can be noted as typical precipitant.

The copper iron composite for decorative use produced in accordance with the present invention serves as an industrial alloy for decorative use which has warm feeling, excellent colorability and desired hardness, since it is composed of a copper based component of 5 to 95% by weight and a balance of Fe and unavoidable impurities, and moreover, its color tone is selectively determined to meet the requirement represented by a formula of $x \geqq 0.3$ and/or $y \geqq 0.3$ for which chromaticity coordinates x and y in a X-Y-Z color colorimetric system are used.

In addition, a color of the decorative article can be changed corresponding to a quantity of solid solution by solid-dissolving Zn, Sn, Ni, Al , Au and Pb in Cu. For example, in case that a quantity of solid solution of Zn in the matrix of Cu is less than 11 parts by weight, the copper iron composite exhibits a light brown having yellow color tone added thereto, in case that it is 11–25 parts by weight, it exhibits a light brown having light orange color tone added thereto, in case that it is 25 to 43 parts by weight, it exhibits a light brown having green color tone added thereto, in case that it is 43 to 54 parts by weight, it exhibits a light brown color having golden color tone added thereto, and in case that it is 54 to 67 parts by weight, it exhibits a light brown color having red color tone added thereto. In addition, in case that a quantity of solid solution of Sn in Cu is less than 3.1 parts by weight, the copper iron composite exhibits a copper red color, in case that it is 3.1 to 11 parts by weight, it exhibits a light brown color having red color tone added thereto, in case that it is 11 to 14 parts by weight, it exhibits a light brown color having gray yellow color tone added thereto, in case that it is 14 to 18 parts by weight, it exhibits a light brown color having white spots and yellow spots mixed with each other, and in case that it is 18 to 25 parts by weight, it exhibits a light brown color having orange yellow color tone added thereto. Further, in case that a quantity of solid solution of Ni in Cu is 11 to 100 parts by weight, the copper iron composite exhibits a light brown color having white color tone added thereto, and as it increases, the white color tone increases correspondingly. In case that a quantity of solid solution of Al in Cu is 5.3 to 14 parts by weight, the copper iron composite exhibits a light brown color having golden color tone added thereto. In case that a quantity of solid solution of Au in Cu is 50 to 100 parts by weight, preferably, 70 to 80 parts by weight, the copper iron composite exhibits a light brown color having golden color tone added thereto. In case that a quantity of solid solution of Pb in Cu is 5 to 55 parts by weight, preferably, 10 to 30 parts by weight, the copper iron composite exhibits a light brown color having yellow color tone added thereto.

Cr and Ni is added the purpose of improving corrosion resistance of the copper iron composite. When a quantity of addition of Cr or Ni exceeds 25% by weight, a hot working properties of the copper iron composite is deteriorated. For this reason, the quantity of addition of Cr or Ni is set to 0 to 25% by weight. It is acceptable that it is set to 11 to 16% by weight. It is desirable that a quantity of solid solution of Cr in Fe is set to 0.1 to 20% by weight and Ni in Fe is 2 to 20% by weight.

EMBODIMENTS

The present invention will now be described in detail below with respect to embodiments thereof.

First, a content of Cu, a content of at least one kind of metal selected from a group consisting of Zn, Sn, Ni, Al , Au and Pb (hereinafter referred to as M) and a content of Cr were selectively determined to coincide with a composition ratio (% by weight) shown in Table 1. Subsequently, a mixture of the raw materials was molten in a high frequency melting furnace to prepare an ingot. After the ingot was forged, it was heated at 900° C. for one hour, and thereafter, it was subjected to hot working to produce a metallic plate having a thickness of 2 mm. After an oxide on the metallic plate was removed, it was subjected to cold rolling to prepare a metallic sheet having a thickness of 1 mm. Subsequently, the metallic sheet was subjected to heat treatment at 850° C. to obtain a metallic sheet for decorative use of which composition is shown in Table 1.

TABLE 1

| | Cu content (wt %) | M content (wt %) | Fe content (wt %) | Cr content (wt %) | Ni content (wt %) | |
|---|---|---|---|---|---|---|
| Example | | | | | | |
| 1 | 70 | | 30 | | | |
| 2 | 50 | | 50 | | | |
| 3 | 49 | Zn 21 | 30 | | | |
| 4 | 57 | Sn 13 | 30 | | | |
| 5 | 38 | Ni 32 | 30 | | | |
| 6 | 64.4 | Al 5.6 | 30 | | | |
| 7 | 90 | | 7.4 | 1.8 | 0.8 | |
| 8 | 70 | | 24.6 | 5.4 | | |
| 9 | 70 | | 22.2 | 5.4 | 2.4 | |
| 10 | 50 | | 37 | 9 | 4 | |
| 11 | 10 | | 66.6 | 16.2 | 7.2 | |
| 12 | 49 | Zn 21 | 22.2 | 5.4 | 2.4 | |
| 13 | 57 | Sn 13 | 22.2 | 5.4 | 2.4 | |
| 14 | 38 | Ni 32 | 22.2 | 5.4 | 2.4 | |
| 15 | 64.4 | Al 5.6 | 22.2 | 5.4 | 2.4 | |
| 16 | 54.6 | Zn 14 Sn 1.4 | 22.2 | 5.4 | 2.4 | |
| 17 | 56.6 | Ni 12.6 Sn 0.8 | 22.2 | 5.4 | 2.4 | |
| 18 | 53.9 | Ni 14 Al 2.1 | 22.2 | 5.4 | 2.4 | |
| 19 | 35 | Au 35 | 22.2 | 5.4 | 2.4 | |
| 20 | 50.9 | Ni 11.7 Zn 7.2 | 24.5 | 6.0 | 2.7 | |
| 21 | 37.3 | Zn 22.4 Pb10.1 | 24.5 | 6.0 | 2.7 | |
| 22 | 37.2 | Zn 24.5 Al 3.5 | 25.7 | 6.3 | 2.8 | |
| 23 | 32.2 | Zn 11.8 Ni 6.3 Pb 16.8 Sn 2.1 | 22.8 | 5.5 | 2.5 | |
| 24 | 70 | | 30 | | | surface treatment A* |
| 24' | 70 | | 30 | | | surface treatment B |
| 25 | 49 | Zn 21 | 22.2 | 5.4 | 2.4 | surface treatment A |
| 25' | 49 | Zn 21 | 22.2 | 5.4 | 2.4 | surface treatment B |
| Comparative Example | | | | | | |
| 1 | 100 | | | | | |
| 2 | 0.1 | | 73.9 | 18 | 8 | |

*Note: The surface treatment A is a decorative article in which Fe of the surface was removed, and B is a decorative article in which Cu of the surface was removed.

With respect to the copper iron composite sheet materials obtained in the above-described manner, the surface of each sample was ground using an abrasive paper (NO. 800), and thereafter, chromaticity coordinates (x, y) of each sample were measured using a differential colorimeter (Minolta CR-21 operable using a reference light beam C), and moreover, appearance and Vickers hardness (Hv) of each sample were measured. The results derived from the measurements are shown in Table 2. Incidentally, with respect to the Vickers hardness, each sheet material having Vickers hardness of 100 Hv or more was determined to be acceptable from the viewpoint of practical usability.

TABLE 2

| | color tone | | | | |
|---|---|---|---|---|---|
| | x | y | appearance | Vickers hardness (Hv) | Total Evaluation |
| Example | | | | | |
| 1 | 0.335 | 0.335 | light brown having red color tone | 191 | acceptable |
| 2 | 0.332 | 0.333 | dark brown | 226 | acceptable |

TABLE 2-continued

| | color tone | | | | |
|---|---|---|---|---|---|
| | x | y | appearance | Vickers hardness (Hv) | Total Evaluation |
| 3 | 0.328 | 0.325 | light brown having green color tone | 180 | acceptable |
| 4 | 0.312 | 0.315 | light brown having yellow orange color | 197 | acceptable |
| 5 | 0.314 | 0.331 | light brown having gray color tone | 221 | acceptable |
| 6 | 0.336 | 0.332 | light brown having yellow golden color | 188 | acceptable |
| 7 | 0.324 | 0.314 | light brown having red color tone | 163 | acceptable |
| 8 | 0.340 | 0.329 | light brown having red color tone | 191 | acceptable |
| 9 | 0.342 | 0.327 | light brown having red color tone | 209 | acceptable |
| 10 | 0.336 | 0.311 | dark brown | 226 | acceptable |
| 11 | 0.331 | 0.313 | silver having light brown tone color | 201 | acceptable |
| 12 | 0.342 | 0.338 | light brown having green color tone | 180 | acceptable |
| 13 | 0.331 | 0.332 | light brown having yellow orange color | 197 | acceptable |
| 14 | 0.329 | 0.326 | light brown having gray color tone | 221 | acceptable |
| 15 | 0.330 | 0.337 | light brown having golden color tone | 188 | acceptable |
| 16 | 0.337 | 0.334 | light brown having gray color tone | 182 | acceptable |
| 17 | 0.329 | 0.318 | light brown having gray color tone added thereto | 215 | acceptable |
| 18 | 0.340 | 0.335 | light brown having golden color tone | 208 | acceptable |
| 19 | 0.340 | 0.325 | light brown having golden color tone | 145 | acceptable |
| 20 | 0.352 | 0.310 | gray having yellow color tone | 200 | acceptable |
| 21 | 0.371 | 0.332 | light brown having yellow color tone | 190 | acceptable |
| 22 | 0.363 | 0.354 | light brown having golden color tone | 232 | acceptable |
| 23 | 0.325 | 0.337 | gray having yellow color tone | 165 | acceptable |
| 24 | 0.402 | 0.359 | red brown color | | |
| 24' | 0.325 | 0,320 | light brown having light gray color | | |
| 25 | 0.384 | 0.350 | light brown having red color tone | | |
| 25' | 0.330 | 0.328 | light brown having gray color tone | | |
| Comparative Example | | | | | |
| 1 | 0.360 | 0.340 | light brown having red color tone | 83 | unacceptable |
| 2 | 0.290 | 0.291 | silver | 153 | unacceptable |

As is apparent from the evaluation on the examples and the comparative examples, the decorative article produced in accordance with the present invention has a desired excellent color tone, hardness or the like as an industrial decorative material.

As described above, since the decorative article produced in accordance with the present invention exhibits not only excellent mechanical properties such as hardness or the like but also warm color tone, it can be concluded that it is suitably employable as a decorative article for an exterior covering material for an electrical apparatus, e.g., a lighting instrument, a refrigerator or the like, a kitchen instrument, transportation apparatus and equipment, a guide plate or the like, an artistic article, a decorative article to be borne by an user or the like.

Next, description will be made in more detail below with respect to the decorative article of the present invention of which outline has been described above.

According to the present invention, the decorative article is a decorative article exhibiting excellent etching properties which is produced such that a copper iron composite constituting the decorative article consists of 5 to 95% by weight of Cu, 5 to 95% by weight of a copper based component having at least one kind of metal selected from a group consisting of Au, Pb, Zn, Sn, Ni and Al solid-dissolved therein and a balance of Fe and unavoidable impurities, wherein the copper iron composite exhibits color tone satisfying a formula of $x \geqq 0.5$ and/or $y \geqq 0.5$ for which are used and wherein the copper iron composite contains a cast structure in at least a part of its matrix and has a dislocation density of $10^2$ dl/cm$^2$ or more.

Generally, a dendritic structure 8 as shown in FIG. 2 to FIG. 5 can be noted as a typical cast structure of the copper iron composite. In the drawings, reference numeral 9 designates randomly oriented grains, reference numeral 10 designates a grain, and reference numeral 11 designates an annealed structure. The dendritic structure (which may be called a columnar crystal) is generated by quickly cooling molten alloy until the latter is solidified. At this time, it is necessary that a cooling rate is set to 100° C./sec or more, preferably, 300° C./sec or more, if possible. A quick cooling process may be practiced by using a single roll. However, it is preferable that an opposing pair of rolls as shown in FIG. 1 are employed for practicing the quick cooling process, because accuracy of a thickness of the rolled plate can easily be adjusted with the rolls. In addition, according to the present invention, secondary rolling or similar treatment is performed with the rolled plate.

Figure 6:
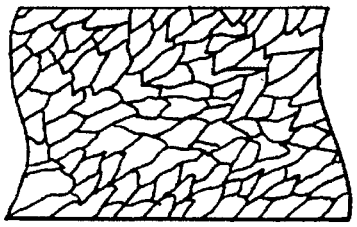
Figure 7:
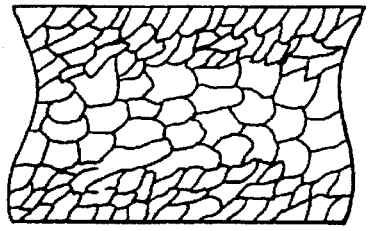
Figure 8:
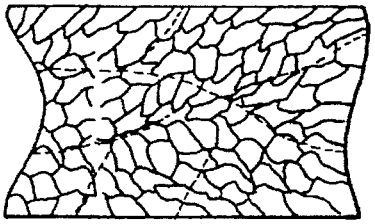
Figure 9:
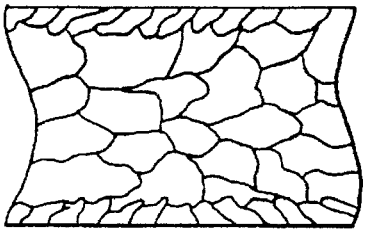

As shown in FIG. 6, the cast structure prepared according to the present invention is a metallurgical structure which extends from the surface of the plate in the direction of a thickness of the latter as if tree's leaves extend. Alternatively, as shown in FIG. 7, a free crystalline structure may be present at the central part of the plate. Otherwise, the metallurgical structure may slightly vary from the surface of the plate. In addition, as shown in FIG. 8, crystalline particles 10 each having a size of several μm to several hundred μm may be present in the plate together with the dendritic structure. Further, as shown in FIG. 9, a part of the dendritic structure may be transformed to an annealed structure 11 by annealing the plate.

To satisfactorily achieve etching, it is recommendable that a thickness of the dendritic structure is set to 1/10 or more of a thickness of the plate, preferably, 1/5 or more of the same as measured from the surface of the plate. Since the rolled plate is cooled from both the surfaces of the plate when an opposing pair of rollers are arranged to roll the molten metal, the arrangement of the rolls in that way is suitably employable especially when etching is achieved from both the surfaces of the plate. Further, since a cooling rate of the plate from both the surfaces of the latter varies by changing a temperature of each of the rolls, growth of the dendritic structure from both the surfaces of the plate can properly be controlled. Thus, it is possible to change an etching rate from both the surfaces of the plate.

On the other hand, the reason why the dislocation density of the copper iron composite is set to $10^2$ dl/cm$^2$ or more consists in maintaining good wetting ability of the plate with an etching liquid and a high mechanical strength of the plate. If the dislocation density is excessively large, the etching rate is excessively increased, resulting in proper controlling of the etching rate becoming difficult. For this reason, it is preferable that the dislocation density is set to the range of $10^4$ to $10^{11}$ dl/cm$^2$. The dislocation density set to the above-noted range can be obtained by rolling the molten alloy under suitable rolling conditions. However, it is possible that the copper iron composite obtains good etching properties to some extent even when it is not subjected to rolling. In addition, crystalline particles can be arranged in alignment with each other with such an orientation as {100}, {110} or the like so as to allow etching to be advantageously achieved without any substantial destroy of the dendritic structure by rolling the cast alloy. It is preferable that the grown dendritic structure is rolled at a roll-down rate of 20% or less under a condition that a diameter of each of the rolls is selectively determined.

Further, the go arounding penetration of the etching liquid into the plate can be improved by concentratively locating added elements in the surface layer of the plate.

It is desirable that a distance between dendrites in the dendritic structure is set to about 1 μm to 100 μm. Especially, when etching is achieved with a small pitch, it is preferable that the value representing the foregoing distance is reduced as far as possible. For this reason, the foregoing distance is set to the range of about 1 μm to 100 μm.

Next, description will be made below with respect to another decorative article produced in accordance with the present invention.

As is well known, a crystalline structure of copper exhibits a face-centered cubic lattice, while a crystalline structure of iron exhibits a body-centered cubic lattice. Thus, various difference arises therebetween depending on conditions such as corrosion or the like. With respect to etching properties of the copper iron composite to be subjected to photoetching, it is acceptable that photoetching is achieved along a {100} plane not only with the crystalline structure including a face-centered cubic lattice but also with the crystalline structure including a body-centered cubic lattice. In view of the aforementioned facts, the decorative article can very easily be worked to the predetermined configuration by etching, when both elements, i.e., copper and iron in the copper iron composite are collectively present with a crystalline orientation coincident with the {100} plane. Thus, it is possible to achieve very fine etching for the decorative article.

To assure that the copper layer and the iron layer are collectively present in the surface layer of the plate to build a {100} plane structure, it is recommendable that copper is annealed at a temperature higher than a recrystallization temperature of Cu and iron is annealed at a temperature lower than that of Fe. In other words, to assure that crystalline particles in the surface layer of the copper iron composite are arranged in alignment with each other with an orientation along the {100} plane, the copper layer is annealed within the temperature range higher than a recrystallization temperature and iron layer is annealed within the temperature range lower than the same after completion of cold working. Specifically, it is recommendable that the copper iron composite is annealed within the temperature range of, e.g., 400° C. to 750° C., although a recrystallization temperature varies depending on conditions such as purity, a degree of working or the like.

Cold rolling is performed to assume a predetermined thickness after the molten alloy is quickly cooled, and thereafter, the cold-rolled plate is annealed so as to allow crystalline particles to be arranged in alignment with each other with a predetermined crystalline orientation {100}. Finally, the plate is subjected to fine rolling in order to adjust the plate to the optimum state in shape and size. At this time, it is acceptable that the roll-down rate is set to a smaller value so as to allow further rotation of a crystalline axis to be suppressed. For example, the roll-down rate is set to 15% or less, preferably, 5% or less.

When the copper layer does not contain a collected structure, a parameter $A_{Cu}$ is determined in accordance with the following equations.

$$A_{Cu} = \frac{I_{Cu}\{200\}}{I_{Cu}\{111\} + I_{Cu}\{220\}} = \frac{46}{120} = 0.38$$

wherein $I_{Cu}\{200\}$, $I_{Cu}\{111\}$, or $I_{Cu}\{220\}$ is a X-ray diffraction intensities of {200}, {111}or {220} plane of Cu plate which does not contain a collected structure.

When the iron layer does not contain any collected structure, a parameter $A_{Fe}$ is determined in accordance with the following equations.

$$A_{Fe}=\frac{I_{Fe}\{200\}}{I_{Fe}\{220\}}=0.2$$

wherein $I_{Fe}\{200\}$ or $I_{Fe}\{220\}$ is X-ray diffraction intensities of {200} or {220} plane of Fe plate which does not contain a collected structure.

The parameters $A_{Cu}$ and $A_{Fe}$ are values which show how the {100} crystalline plane extends in parallel with the plate surface, and when the {100} plane is collectively present, the parameters $A_{Cu}$ and $A_{Fe}$ are represented by inequalities of $A_{Cu}>0.38$ and $A_{Fe}>0.5$.

When a decorative article is worked by etching, alignment of the {100} plane with the plate surface is achieved when either of two conditions each represented by the following is satisfied. It has been found that the decorative article of the copper iron composite exhibits excellent etching properties.

Figure 10:
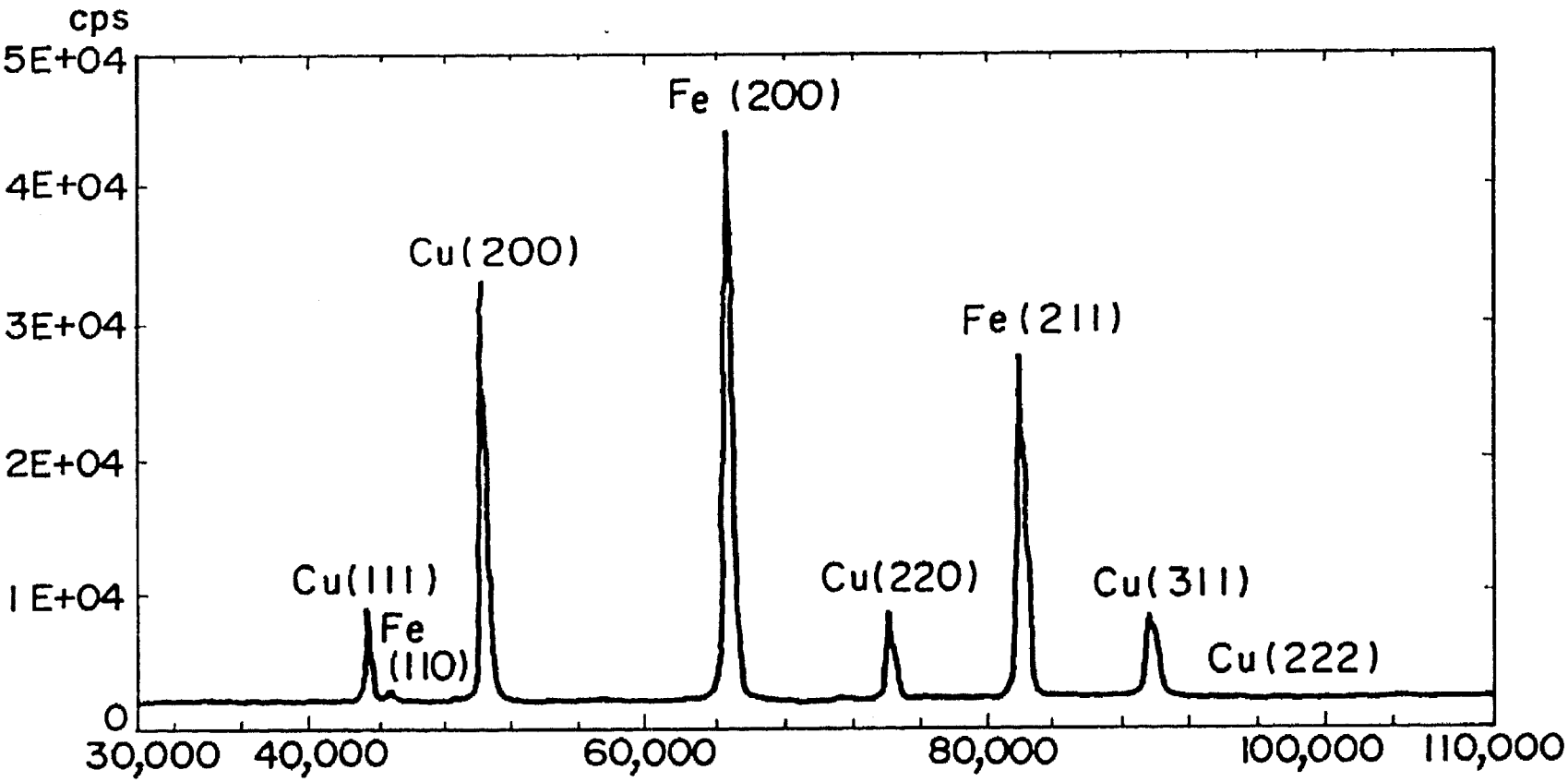
FIG. 10 is a graph which shows a X-ray diffraction intensity of a sheet of decorative article made of the copper iron composite plate produced according to the present invention.

(1) $A_{Cu}\geqq 1$ and $A_{Fe}\geqq 0.5$ (2) $A_{Cu}\geqq 0.38$ and $A_{Fe}\geqq 2$ FIG. 10 is a diagram which shows data derived from X-ray diffraction conducted for the copper iron composite plate in which both of copper and iron are collectively present in the {100} plane. As is apparent from the drawing, a decorative article having excellent etching properties can be obtained using the copper iron composite plate of the present invention. In the drawing, an abscissa shows 2θ and an ordinate shows diffraction intensity. Cukα is used as X rays. Copper in the copper iron composite plate exhibits high diffraction intensity along a {200}1 plane compared with a {111} plane and a {220} plane. In other words, the {100} planes are collectively present in the surface layer of the copper iron composite plate. Iron in the copper iron composite plate exhibits high diffraction intensity along a {200} plane compared with a {110} plane. In other words, the {100} plane is collectively present in the surface layer of the copper and iron alloy plate.

It should be noted that the conditions (1) and (2) should not be applied only to the decorative article but they are equally applied to various kinds of articles, provided that each of them is worked to a desired configuration by etching a metallic plate which is produced by quickly cooling a molten alloy.

Suitable heat treatment may be conducted before the molten alloy is quickly cooled and then subjected to cold rolling, in order to prevent an occurrence of cracking during the cold rolling, since the crystalline orientation is not affected at all.

The decorative article having excellent etching properties as mentioned above is suitably employable especially not only as an exterior lining material and an interior lining material for apparatuses and instruments for which excellent decorativeness and designability such as a fine pattern or the like are required but also for an artistic article.

Next, description will be made with respect to the decorative article which has been subjected to surface treatment.

First, description will be made below with respect to a decorative article having a gradient structure wherein a Cu concentration is high in the surface layer of the decorative article but it is gradually reduced toward the inner layer. Specifically, a ratio n2/n1 of the Cu concentration n2 in the surface layer of the decorative article to the Cu concentration n1 in the matrix of the same is determined to be larger than 1. Formation of an oxide film of which surface has a large thickness can be suppressed by reducing a weight ratio of Fe in the surface layer to be smaller than that in the matrix, resulting in a decorative article having excellent resistance against oxidization being obtained. In addition, fine variation in respect of color tone and brightness of the decorative article is recognized. The Cu concentration n1 in the matrix and the Cu concentration n2 in the surface layer of the decorative article can be obtained by measuring a concentration in each bulk portion and a concentration in the surface layer by using, e.g., an auger electron spectroscopy. It is acceptable that a thickness of the surface layer is determined to remain within the range where a strength of the matrix is deteriorated. It is suitably employable that it remains within the range of 100 A to 5 μm. It should be noted that red color tone of the decorative article is intensified as the value of n2/n1 becomes large more and more.

When a copper oxide film is formed on the uppermost (outermost) surface of the surface layer, more advantageous effects can be obtained with the decorative article. This is because the formation of the oxide film in that way is effective for suppressing progressive oxidization of the surface of the matrix. When a thickness of the oxide film is less than 10 A, progressive oxidization of the surface of the oxide film can not be suppressed. On the contrary, when the thickness of the oxide film exceeds 1000 A, the decorative article does not exhibit color tone of the matrix itself. For this reason, it is preferable that the thickness of the oxide film is determined to remain within the range of 100 A to 500 A. In addition, it is desirable that $Cu_2O$ is formed as an oxide film.

It is acceptable that anion derived from bromine, iodine, nitric acid, nitrous acid, acetic acid, phosphoric acid, pyrophosphoric acid, tripoliphosphoric acid, sulfuric acid, sulfurous acid, fluorine, chlorine or the like, an alkaline metal such as sodium, potassium or the like and at least one kind of organic acid selected from a group consisting of citric acid, tartaric acid, oxalic acid and lattice acid are contained preferably in the surface layer of the decorative article, more preferably in the outermost surface layer of the same. When a total amount of the anion, the alkaline metal and the organic acid exceeds 10 ppm, corrosion resistance of the decorative article is deteriorated. For this reason, it is desirable that the foregoing total amount is determined to be 2 ppm or less. A concentration of each of the aforementioned materials can quantitatively be measured by way of the following steps.

About 1 gram of a sample of the decorative article is weighed and pure water of 20 ml is then added to the sample. The resultant solution is put in an inner container molded of teflon placed in a pressurized decomposing container, and thereafter, the pressurized decomposing container is airtightly closed with a lid. Subsquently, the pressurized decomposing container is heated in an oven at 200° C. for two hours so as to elude the anion from the solution. The alkaline metal in the sample is quantitatively measured by employing a frameless atomic light absorbing process, while the anion and the organic acid are quantitatively measured by employing an ion chromatography process. Weight (g) of the eluded component relative to weight (g) of the sample of the decorative article is called a weight concentration (ppm).

An oxide film on the surface of the decorative article having a gradient structure of Cu concentration and an anion contained in the surface layer of the decorative article can be obtained by, e.g., surface treatment to be conducted in the following manner.

First, the surface of the decorative article having a predetermined composition is subjected to acid treatment to selectively remove Fe therefrom. For example, at least one kind of acid selected from a group consisting of diluted nitric acid, diluted sulfuric acid, diluted acetic acid, diluted hydrochloric acid and diluted fluoric acid or a mixture solution containing the aforementioned acids and an aqueous solution of hydrogen peroxide or a mixture solution added with an acid selected from a group consisting of phosphoric acid, pyrophosphoric acid, tripoliphosphoric acid, citric acid, tartaric acid and oxalic acid can be noted as an acid to be used for the purpose of removing Fe. Although operative conditions such as a concentration or the like to be employed during the acid treatment vary depending on the kind of acid employed for the acid treatment, a good copper oxide film can be formed on the outermost surface of the decorative article under the suitably selected operative conditions while properly controlling a thickness of the oxide film.

It is desirable that especially, diluted fluoric acid or a mixture solution consisting of diluted hydrochloric acid and an aqueous solution of hydrogen peroxide is employed for the purpose of acid treatment. A concentration of the etching solution employed for the acid treatment is not specifically defined but it varies depending on an etching time, an etching temperature or the like. For example, etching can be achieved for 10 minutes by using an etching solution of fluoric acid having a concentration of 0.1 to 1N or a mixture etching solution consisting of hydrochloric acid having a concentration of 0.01 to 1N and an aqueous solution of hydrogen peroxide having a concentration of 0.01 to 10%. In such manner, Fe in the surface layer of the decorative article can be removed with a high degree of selectivity, and moreover, a highly excellent $Cu_2O$ film can be formed on the surface layer of the decorative article.

In addition, a concentration of each of the anion, the alkaline metal and the organic acid can properly be controlled by washing the surface of the decorative article using hot water (hereinafter referred simply as hot water treatment) after the surface of the decorative article is subjected to acid treatment in the above-described manner. At this time, oxidizing is progressively performed as the hot water treatment is conducted. For this reason, it is acceptable that a treatment time is set to about 5 to 10 minutes and a treatment temperature is set to about 60° to 80° C.

Further, a surface portion is formed directly on the surface of the decorative article after completion of the surface treatment by forming a film having a Cu content or a Cu concentration higher than that in the matrix, and thereafter, forming a $Cu_2O$ film by treating the outermost surface of the decorative article. A concentration of each of the anion, the alkaline metal and the organic acid can be controlled by allowing the surface portion to be subjected to hot water treatment.

The decorative article having a high Cu concentration in the surface layer as mentioned above is suitably employable as an interior lining material and an exterior lining material for a structure body or the like requiring more warm color tone and more excellent corrosion resistance.

When an oxide layer is formed on the surface of the decorative article in the above-described manner, color tone and brightness of the decorative article vary delicately. To form the oxide layer, an oxide derived from one or more selected from a group consisting of Ti, Zr, Y, Ce, S, Al , N, Ni, Zn, V, Si, Pb, Fe and Co, P, Mg, Be, Mn, W, Mo, No, Cr is used in addition to a Cu oxide. When a thickness of the oxide layer is less than 10 A, progress of oxidization of the decorative article can not be suppressed, and moreover, variation of the color tone and the brightness of the decorative article are not recognized. On the contrary, when the thickness of the oxide layer exceeds 1 μm, the substrate of the decorative article does not exhibit its own color. For this reason, it is preferable that thickness of the oxide layer is determined to remain within the range of 100 A to 5000 A, and it is more preferable that it is determined to remain within the range of 100 A to 1000 A.

The oxide layer can be subjected to surface treatment by employing, e.g., a chemical process of oxidizing added elements using heat, an acid or the like, a physical process of distributing oxide particles over the substrate of the decorative article or coating the former on the latter or a composite process of combining the chemical process with the physical process. Alternatively, an oxide layer is selectively formed on the substrate using a mask such as an ordinary resist or the like. Otherwise, a part of the oxide layer may selectively be removed using another mask by dipping the substrate in an aqueous hydrochloric acid solution having a concentration of, e.g., 0.5 to 5N. The state of formation of the oxide layer can easily be confirmed by using a X-ray photoelectron spectroscopy or the like.

Next, description will be made below with respect to the decorative article which has been subjected to surface layer wherein a layer including a Fe phase having a large thickness is formed on the surface layer of the copper iron composite from which Cu is removed.

First, Cu is selectively dissolved in a solution by chemical etching or electrolytic grinding so that Fe in the surface layer of the copper iron composite is concentrated to form a surface layer containing a Fe phase having a relatively large thickness. At least one kind of solution selected from a group consisting of an aqueous solution of nitric acid, inorganic ammonia water, organic ammonia water and an organic solvent containing amine (organic amine based solution) is used as a chemical etching liquid. In addition, phosphoric acid solution diluted with water is used for achieving electrolytic grinding. In case that a surface of the decorative article has high ruggedness, a raw material of copper iron composite is subjected to skin pass rolling (low intensity rolling) so as to allow the surface of the copper iron composite to be smoothened. When it is assumed that a Fe concentration in the surface layer of the decorative article is represented by n4 and a Fe concentration in the matrix of the same is represented by n3, light color tone of the decorative article is intensified as a value of n4/n3 increases more and more.

According to the present invention, it is desirable that an oxide film having a thickness of 20 to 1000 A is formed on the outermost surface of the copper iron composite. This is because the formation of the oxide film in that way is effective for suppressing progress of corrosion over the decorative article. When a thickness of the oxide film is less than 20 A, progress of the corrosion can not be suppressed. On the contrary, when the thickness of the oxide film exceeds 1000 A, surface hardness is reduced. For this reason, it is desirable that the thickness of the oxide film is determined to remain within the range of 50 to 500 A.

It is acceptable that at least one kind of material selected from a group consisting of anion, alkaline metal, organic acid, alkaline organic amine and ammonia is contained in the surface portion. Bromine, iodine, nitric acid, nitrous acid, acetic acid, phosphoric acid, pyrophosphoric acid, tripoliphosphoric acid, sulfuric acid, sulfurous acid, fluoric acid and chlorine can be noted as a material for the anion. Sodium, potassium or the like can be noted as an alkaline metal. Hydroxide tetramethyl-ammonium, choline or the like can be noted as alkaline organic amine.

When a content of anion, alkaline metal, organic acid, alkaline organic amine or ammonia exceeds 10 ppm, inner corrosion of the decorative article progresses, causing wear resistance of the decorative article to be readily reduced. Thus, it is desirable that a content of one of the aforementioned materials is set to 2 ppm or less.

A process to be practiced by way of the steps of forming a member made of a desired Cu-Fe based alloy by employing, e.g., a twin roll process, a casting process or the like and then selectively etching Cu on the surface of the member using a solution containing at least one kind of material selected from a group consisting of ammonia, alkaline organic amine and nitric acid or electrolytically etching it in a solution containing nitric acid to concentrate Fe in the surface layer of the decorative article can be noted as a process of producing a decorative article. It is desirable that the decorative article is washed using hot water after completion of a final step of the foregoing process.

The decorative article having a high Fe concentration in the surface layer is suitably employable for a structure body for which higher surface strength and more excellent wear resistance are required.

Mechanical etching such as grinding, sand blasting, fluid blasting, cavitation or the like may be applied to the resists which has been subjected to surface treatment by the chemical etching as mentioned above so as to change color tone of the decorative article.

A few embodiments of a decorative article for which the copper iron composite of the present invention is used will be described below.

EMBODIMENT

To produce a copper iron composite for decorative use, Fe of 22.2% by weight, Cr of 5.4% by weight, Ni of 2.4% by weight, Al of 5.6% by weight and a balance of Fe and alloy components of 1% by weight or less consisting of Mn, Zn, P, S and Si were molten in a high frequency furnace and the molten alloy was received in a turndish from which it was poured between an opposing pair of rolls. A cooling rate was set to 1000° C./sec and a plate thickness was set to about 1mm. The opposite extra edges of the plate were cut off and scale on the opposite surfaces of the plate was removed by mechanical grinding and pickling. Subsequently, after the plate was annealed, it was rolled twice until a sheet of copper iron composite having a thickness of 0.25 mm was produced. A dislocation density of the alloy sheet was $10^6$ dl/cm$^2$. A cast structure still remained in the alloy sheet while extending in the rolling direction, and a Cu phase and a Fe phase were substantially separated from each other to form two phases. After completion of recrystallization, crystal particles were classified into NO. 6 specified by JIS G0551. A transition density of each crystal was $10^6$ to $10^7$ dl/cm$^2$, and Al was solid-dissolved in the Cu phase. The surface of the alloy sheet was coated with a photoresist which in turn was solidified by burning. Subsequently, a mask pattern having a predetermined contour was brought in close contact with the surface of the alloy sheet which in turn was exposed to ultraviolet rays. The photoresist was peeled away only from the exposed part of the alloy sheet which was etched using ferric chloride, and thereafter, the remaining photoresist was peeled away from the alloy sheet. Consequently, a decorative article having warm color tone was produced.

EMBODIMENT

To produce a display board, a copper iron composite consisting of Cu of 49% by weight, Zn of 21% by weight, Fe of 22.2% by weight and Cr of 5.4% by weight, Ni of 2.4% by weight was first molten and the molten alloy was then poured between an opposing pair of rolls and quickly cooled to produce a copper iron composite plate for decorative use having a thickness of 2 mm. A cooling rate was set to 300° C./sec. After an oxide film on the surface of the alloy plate was removed, the alloy plate was rolled without annealing and the resultant alloy sheet was cut out to dimensions of 200×1000 mm. A dislocation density of the alloy sheet was $10^{11}$ dl/cm$^2$ and it was found that Zn was solid-dissolved in a Cu phase. The surface of the alloy sheet was ground using an abrasive paper NO. 600, and thereafter, it was subjected to mirror finishing using diamond particles each having a size of 0.05 μm. Subsequently, the surface of the alloy sheet was coated with photoresist so that characters "TOSHIBA" on the resist coated surface was exposed to light beam. Only the photoresist on the exposed character portions was removed from the surface of the alloy sheet which in turn was dipped in an aqueous solution of ferric chloride. When etching was achieved to reach a depth of about 0.5 mm, the alloy sheet was taken up from the solution and then washed using water, and thereafter, the remaining photoresist was peeled away from the alloy sheet by dipping the latter in an aqueous solution of sodium hydroxide. Subsequently, the alloy sheet was washed again using water, whereby a desired display plate was produced.

EMBODIMENT

Molten metal of copper iron composite consisting of Cu of 35% by weight, Fe of 37% by weight, Zn of 15% by weight and Cr of 9% by weight, Ni of 4% by weight was continuously cast between an opposing pair of rolls to produce an alloy plate having a thickness of 2.2mm. After the alloy plate was annealed at 700° C. for one hour, it was subjected to cold rolling at a roll-down rate of 95% to produce an alloy sheet having a thickness of 0.11 mm. Subsequently, the alloy sheet was subjected to heat treatment for 10 minutes at a temperature of 650° C. which was higher than Cu recrystallization temperature but lower than Fe recrystallization temperature. A crystal orientation of the resultant alloy sheet was measured which revealed that $A^{Cu}$ was equal to 3.2 and $A_{Fe}$ was equal to 15.8. Since warpage occurred with the alloy sheet after the heat treatment of the latter at 650° C. for 10 minutes, finish rolling was performed for the alloy sheet at a roll-down rate of 2.8%. As a result, it was found that $A_{Cu}$ was equal to 1.8 and $A_{Fe}$ was equal to 12.8.

The resultant alloy sheet was etched and then worked to a decorative article (name plate). Consequently, the decorative article exhibited excellent etching properties and high accuracy.

A decorative article produced in accordance with the present invention can be used not only as a structural material but also as an interior/exterior lining material for electrical products, buildings, transportation machines and equipments, medical apparatuses and instruments or the like.

In view of the fact that the decorative article of the present invention is excellent in respect of corrosion resistance, forming workability, weldability, mechanical strength, heat resistance and designability, a ceiling plate and a door side of refrigerator, an interior lining of an electric range, an interior lining of a toaster, a washing tab of a washing machine, an exterior lining of a refrigerator for business use, an exterior lining of an ice maker for business use, an inner wall of an electrical pot, a reflective plate of an electrical stove, a blade of a shaver, an iron and a sunbeam collecting plate of a solar water heater can be noted as typical application fields of the decorative article usable for electrical products.

In view of the fact that the decorative article is excellent in respect of corrosion resistance, mechanical strength, forming workability, weldability, fire-proofness, wear resistance and designability, an interior/exterior lining material such as a roof, an outer wall, an inner wall or the like, a verity of fittings such as a door, a sash, a shutter, a hand-rail or the like, a furniture such as a sink, a gas table, a cooking table, a hood, a bath tab or the like and an equipment such as an elevator, an escalator, a lighting instrument or the like can be noted as typical application fields of the decorative article usable as a building material.

In view of the fact that the decorative article is excellent in respect of corrosion resistance, mechanical strength, forming workability, weldability, wear resistance and designability, an exterior/interior lining material for railway vehicles can be noted as a typical application field of the decorative article usable for transportation machines and equipments.

In view of the fact that the decorative article is excellent in respect of corrosion resistance, forming workability, weldability and designability, a support column for a X-ray inspecting equipment, a pipe hanger, a developing unit, medical operation equipment and instrument, a platform for medical operations, a scissor and a pincette can be noted as typical application fields of the decorative article usable for medical apparatuses and instruments.

Especially, in case that excellent corrosion resistance is required for the decorative article (as an exterior lining material or a kitchen instrument), it is desirable that Cr or the like is solid-dissolved in a Fe phase, Fe in the surface layer is selectively removed and an oxide film is formed on the surface of the decorative article.

In addition, in case that excellent wear resistance is required for the decorative article (usable for buildings and transportation services), it is desirable that Cu in the surface layer is selectively removed and an oxide film having excellent lubricability is formed on the surface of the decorative article.

Finally, the decorative article of the present invention having a Fe phase and a Cu phase dispersed therein is very suitably employable as a decorative article for which high vibration-proofness is required (as a decorative article for electrical products, buildings and transportation machines and instruments).

What is claimed is:

1. A decorative article having a two phase Cu-Fe structure, which essentially consists of a copper phase and an iron phase;

said decorative article comprising:

a surface;

5 to 95% by weight of a copper based component selected from the group consisting of Cu and a copper alloy, wherein said copper alloy is a copper solid solution, said copper alloy comprising not more than 100 parts by weight of at least a metal selected from the group consisting of Au, Pb, Zn, Sn, Ni and Al based on 100 parts by weight of Cu;

0 to 20% by weight of Cr;

0 to 25% by weight of Ni; and the balance of Fe and unavoidable impurities, wherein the {100} planes of the copper phase and iron phase contained at the surface of said decorative article are substantially parallel to the surface of said decorative article.

2. A decorative article comprising:

a two phase separated Cu-Fe composite, which essentially consists of a copper phase and an iron phase, wherein said decorative article has a color tone satisfying the formula of $x \geqq 0.3$ and/or $y \geqq 0.3$ for color tone coordinates x and y in the X-Y-Z colorimetric system.

3. The decorative article according to claim 1, wherein said decorative article has a Vickers hardness of 100 Hv or more.

4. The decorative article according to claim 1, wherein said decorative article contains a cast structure in at least a part of its matrix and has a dislocation density of $10^2$ dl/cm$^2$ or more.

5. The decorative article according to claim 4, wherein said decorative article contains a cast structure in at least a part of its matrix and has a dislocation density of $10^4$ to $10^{11}$ dl/cm$^2$.

6. The decorative article according to claim 4, wherein said decorative article contains a dendritic structure which extends from the surface to the inside of said article.

7. The decorative article according to claim 4, wherein said decorative article is a plate having a dendritic structure whose thickness from the surface of said plate is 1/10 or more of the thickness of said plate.

8. The decorative article according to claim 4, wherein said decorative article contains a dendritic structure in at least a part of its matrix, a distance between adjacent dendrites is in the range of 1 μm to 100 μm.

9. The decorative article according to claim 1, wherein the peak intensity $A_{Cu}$ of X-ray diffraction of said copper crystals satisfies a following formula, $$A_{Cu} = \frac{I_{Cu}\{200\}}{I_{Cu}\{111\} + I_{Cu}\{220\}} \geqq 0.38$$

wherein $I_{Cu}\{200\}$, $I_{Cu}\{111\}$ and $I_{Cu}\{220\}$ are respectively the X-ray diffraction intensity of {200} plane, {111} plane and {220} plane of Cu, and the peak intensity $A_{Fe}$ of X-ray diffraction of said iron crystals satisfies a following formula, $$A_{Fe} = \frac{I_{Fe}\{200\}}{I_{Fe}\{220\}} \geqq 0.5$$

wherein $I_{Fe}\{200\}$ and $I_{Fe}\{220\}$ are respectively the X-ray diffraction intensity of {200} plane and {220} plane of Fe.

10. The decorative article according to claim 1, wherein a concentration of said copper based component in the surface layer of said decorative article is larger than that in the inner layer of said decorative article.

11. The decorative article according to claim 1, wherein an oxide film having a thickness of 20 A to 1000 A is formed on the outermost surface of said decorative article.

12. The decorative article according to claim 11, wherein said oxide film mainly comprises $Cu_2O$.

13. The decorative article according to claim 11, wherein said oxide film mainly comprises an oxide of at least one element selected from the group consisting of Ti, Zr, Y, Ce, S, Al , N, Ni, Zn, Pb, Cr, Cu, Fe, V, Si, P, Be, Mn, W, Mo and Nb .

14. The decorative article according to claim 1, wherein a concentration of Fe component in the surface layer of said decorative article is larger than that in the inner layer of said decorative article.

15. The decorative article according to claim 1, wherein said decorative article is an interior or exterior material for electrical products.

16. The decorative article according to claim 1, wherein said decorative article is an interior or exterior material for buildings.

17. The decorative article according to claim 1, wherein said decorative article is an interior or exterior material for transportation machines and equipments.

18. The decorative article according to claim 1, wherein said decorative article is an interior or exterior material for medical apparatuses and instruments.

19. A decorative article comprising:

a surface;

a two phase Cu-Fe structure consisting essentially of a copper phase and iron phase, said copper phase comprising 5 to 95 weight percent of said structure, said copper phase being selected from the group consisting of Cu and Cu alloys, said copper alloys consisting essentially of a solid solution comprising no more than 100 parts by weight of at least a metal selected from the group consisting of Au, Pb, Zn, Sn, Ni and Al based on 100 parts by weight of Cu, and balance Fe and unavoidable impurities;

wherein said decorative article has a color tone satisfying the formula of $x>0.3$ and/or $y>0.3$ for color tone coordinates x and y in the X-Y-Z colorimetric system; and the {100} planes of the copper phase and iron phase contained at the surface of said decorative article are substantially parallel to the surface of said decorative article.

20. The decorative article according to claim 19, further comprising up to 20 weight percent Cr.

21. The decorative article according to claim 19, further comprising up to 25 weight percent Ni.

22. The decorative article according to claim 19, further comprising 0 to 20 weight percent Cr and 0 to 25 weight percent Ni.

* * * * *

UNITED STATES PATENT AND TRADEMARK OFFICE

CERTIFICATE OF CORRECTION

PATENT NO. : 5,643,679

DATED : July 01, 1997

INVENTOR(S) : Yoko ISHIMARU et al.

It is certified that error appears in the above-indentified patent and that said Letters Patent is hereby corrected as shown below:

Claim 13, column 18, line 46, after "P,", insert --Mg,--.

Signed and Sealed this

Sixth Day of January, 1998

Bruce Lehman

*Attest:*

BRUCE LEHMAN

*Attesting Officer*

*Commissioner of Patents and Trademarks*